United States Patent [19]

Manthe et al.

[11] Patent Number: 4,845,460

[45] Date of Patent: Jul. 4, 1989

[54] MULTIPOLE LOW-VOLTAGE CIRCUIT BREAKER WITH AN INSULATING MATERIAL HOUSING AND ARC-QUENCHING CHAMBERS

[75] Inventors: Karl-Heinz Manthe; Martin Boettcher; Bernhard Pfeiffer, all of Berlin, Fed. Rep. of Germany

[73] Assignee: Siemens Aktiengesellschaft, Berlin and Munich, Fed. Rep. of Germany

[21] Appl. No.: 248,779

[22] Filed: Sep. 23, 1988

[30] Foreign Application Priority Data

Sep. 23, 1987 [DE] Fed. Rep. of Germany ..... 3732472

[51] Int. Cl.[4] ..... H01H 9/30; H01H 33/60

[52] U.S. Cl. ..... 335/201; 200/144 R; 335/8; 337/45

[58] Field of Search ..... 200/144 R, 144 C, 149 A; 335/8, 9, 10, 201; 337/45

[56] References Cited

U.S. PATENT DOCUMENTS

| | | | |
|---|---|---|---|
| 3,394,329 | 7/1968 | Heft | 335/201 |
| 4,247,746 | 1/1981 | Kidd | 200/147 |
| 4,540,961 | 9/1985 | Maier | 335/16 |

FOREIGN PATENT DOCUMENTS

| | | |
|---|---|---|
| 0062350 | 10/1982 | European Pat. Off. . |
| 893826 | 9/1953 | Fed. Rep. of Germany . |
| 1413915 | 1/1969 | Fed. Rep. of Germany . |

*Primary Examiner*—H. Broome

*Attorney, Agent, or Firm*—Kenyon & Kenyon

[57] ABSTRACT

A multipole low-voltage circuit breaker with an insulating material housing and arc quenching chambers. By a new mechanical design, the installation of the arc quenching devices is to be facilitated. All arc quenching chambers of a switchgear are arranged in a quenching chamber housing which is subdivided by partitions and is fastened to the insulating material housing of a circuit breaker. The quenching baffles are fastened directly to the walls of the arc quenching chambers. A low-voltage circuit breaker with an insulating material housing of compact design is thus provided.

6 Claims, 2 Drawing Sheets

MULTIPOLE LOW-VOLTAGE CIRCUIT BREAKER WITH AN INSULATING MATERIAL HOUSING AND ARC-QUENCHING CHAMBERS

BACKGROUND OF THE INVENTION

The present invention relates to a multipole low-voltage circuit breaker with an insulating material housing and one arc quenching chamber for each pole comprising quenching baffles. Such a circuit breaker has become known, for instance, through U.S. Pat. No. 4,540,961. The quenching baffles of a quenching chamber form a block which is held together by insulating parts and can be inserted into the quenching chamber. An example of the arrangement of the insulating parts can be seen from U.S. Pat. No. 4,247,746. It is also known to use, for holding together the quenching baffles, insulating materials which are decomposed under the influence of the heat of the switching arc, forming gas, and thereby promoting the quenching of the arc.

SUMMARY OF THE INVENTION

The known design of the arc quenching chambers can be applied in principle to circuit breakers which are designed for rather different current ratings.

It is an object of the invention to provide for multipole circuit breakers with a low current rating, i.e., preferably below 100 A, a new design of the arc quenching chamber which leads to an improved utilization of space and thereby increases the switching capacity of the circuit breaker for a given volume of the latter.

The above and other objects of the invention are achieved by the provision that all quenching chambers are arranged in a single quenching chamber housing which is subdivided by partitions and is connected to the insulating material housing of the circuit breaker, and that the quenching baffles are fastened to the walls of the quenching chambers. Thereby, the present by holding holding parts for the quenching baffles are eliminated and as well as dimensional tolerance required up to now which were necessary for inserting the quenching baffle blocks into the quenching chambers.

For fastening to the walls of the quenching chambers, these walls can be provided with recesses for receiving the quenching baffles. Since the quenching chamber housing can be manufactured as a single part, inserting the quenching baffles presents no difficulties.

As already mentioned, it is known to use gas-dispensing materials in the construction of arc quenching chambers. Within the scope of the invention, use can be made thereof in such a manner that the walls of the quenching chambers, starting from the passage openings for the movable contact levers, are made expanding, for instance, in wedge-fashion and that the walls consist of a material which gives off gas under the influence of the temperature of the arc. Due to this design, a reflection effect is exerted on the arc discharge which drives the discharge away from the passage openings in the direction toward the opposite chamber outlet.

The connection of the insulating material housing of the circuit breaker to the quenching chamber housing can be accomplished by the provision that the insulating material housing has a recess adapted to the quenching chamber housing. Likewise, a connection by suitable additional elements can be considered. Thus, the quenching chamber housing can also be designed so that it corresponds to the width of the insulating material housing and locally forms the outside walls thereof.

For switchgear contactors, it is known to provide multipole quenching chamber heads of quenching chamber blocks (DE-C No. 893,826). This design of switchgear, however, has differently formed current paths than are exhibited by compact circuit breakers with an insulating material housing. Contactors have a compact part of the equipment which contains an electromagnetic actuating device for two series-connected interruption points. The terminals of these current paths are likewise located at the equipment part and are covered up by a multipole quenching chamber unit which thus rests on the equipment parts like a cap. Such a design is not applicable to circuit breakers of the design considered above, because in the latter, the quenching chambers are located within the insulating material housing between the switching mechanism and the terminal arranged at the end face of the insulating material housing.

BRIEF DESCRIPTION OF THE DRAWINGS

The invention will be explained in greater detail in the following, making reference to the embodiments shown in the figures, in which.

DETAILED DESCRIPTION

Figure 1:
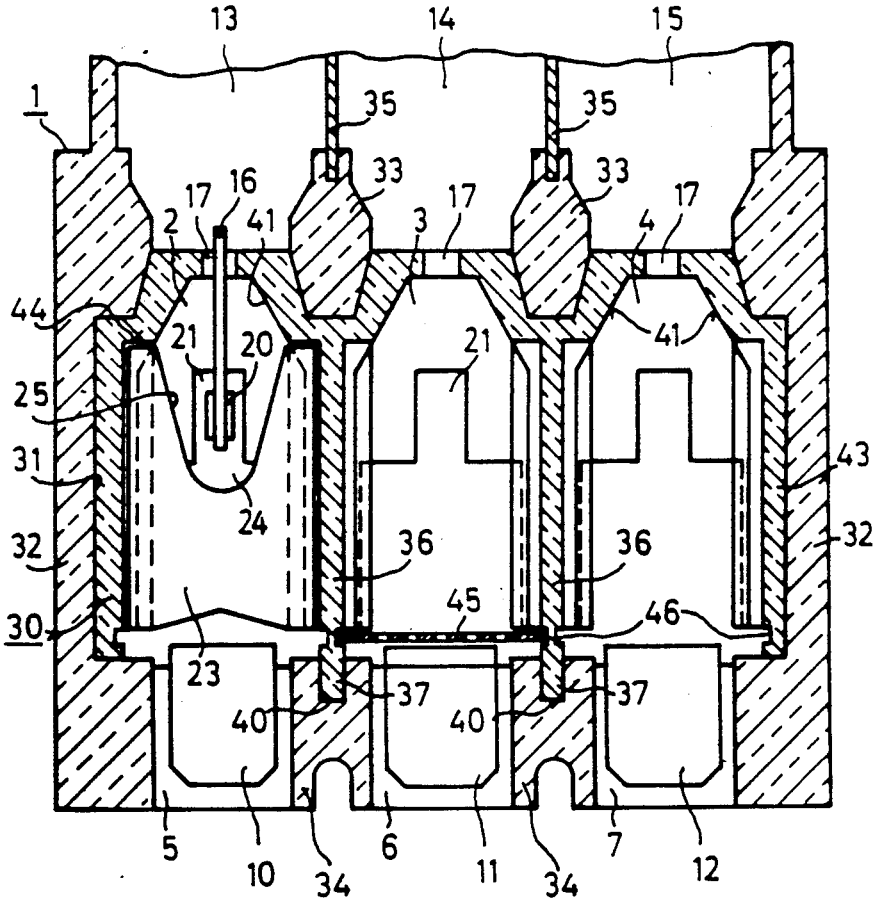
FIG. 1 shows part of the lower housing part of a low-voltage circuit breaker of compact design in a top view, one quenching chamber housing being shown in cross section.

In FIG. 1 is shown, broken away, a lower housing part 1 of a low-voltage circuit breaker of compact design. The lower housing part 1 is provided for a three-phase circuit breaker and accordingly comprises three arc quenching chambers 2, 3 and 4. With respect to the general design of circuit breakers of the type considered here, reference is made to U.S. Pat. No. 4,540,961 mentioned at the outset, so that a presentation of the entire switchgear can be dispensed with It should be mentioned, however, that the arc quenching chambers 2, 3, and 4 are preceded at the end face of the lower housing part 1, with connecting spaces 5, 6 and 7, in which terminals for conductors to be connected are located. In FIG. 1, only one bus bar 10, 11 and 12 is shown as the basis of such a terminal device. On the side of the arc quenching chambers 2, 3 and 4 opposite the connecting spaces 5, 6, and 7 are located further housing chambers 13, 14 and 15 which serve for receiving the switching mechanism, not shown, and a switching shaft, as is generally known. However, in the vicinity of the arc quenching chamber 2 and the housing chamber 13, a movable contact lever 16 is shown in part which extends through a passage opening 17 of the arc quenching chamber 2 and protrudes into the latter. There, the contact lever 16 cooperates with a fixed mating contact 20 which is in conducting contact with the terminal located in the connecting space 5. For access to the mating contact 20 to the quenching chambers 2, 3 and 4, openings 21 are provided at the bottom of the quenching chamber housing 30. Further fixed mating contacts 20 are shown in the arc quenching chambers 3 and 4. It can further be seen that the arc quenching chamber 2 contains quenching baffles 23. To facilitate understanding, the quenching baffles 23 have been omitted in the adjacent arc quenching chambers 3 and 4. In a manner known per se, the quenching baffles 23 are provided with a wedge-shaped cutout 24 rounded at the closed end, whereby the legs 25 are formed which enclose the end of the contact lever 16 and the mating contact 20 cooperating therewith laterally.

The arc quenching chambers 2, 3 and 4 are contained in a quenching chamber housing 30 of their own which is in turn inserted into a matching recess 31 of the lower housing part 1. This recess is formed by the outside walls 32 as well as by post-like wall parts 33 and 34 which are arranged in the line of partitions 35 of the lower housing part 1. Partitions 36 of the quenching chamber housing 30 are provided with strip-like projections 37 which engage with corresponding slots 40 of the wall parts 34 of the lower housing part 1. Thereby, the electrical leakage paths between the adjacent quenching chambers 2 and 3 as well as 3 and 4 are decreased in an appropriate manner.

A peculiarity of the arc quenching chambers 2, 3 and 4 is the wedge-shaped form near the passage openings 17. The wall surfaces 41 which are arranged at an angle to the longitudinal direction of the contact levers 16 reflect pressure waves emanating from the switching arc in such a manner that an accelerated spreading of the arc discharge in the direction of the quenching baffles 23 sets in and the switching performance is improved thereby through the better quenching action. In order to increase this effect still further, the quenching chamber housing 30 can be made of a material which gives off a gas under the influence of the heat of the switching arcs. However, it may suffice to provide or coat the quenching chamber housing 30 only in the vicinity of the wall surfaces 41 with such a gas-dispensing material.

Figure 2:
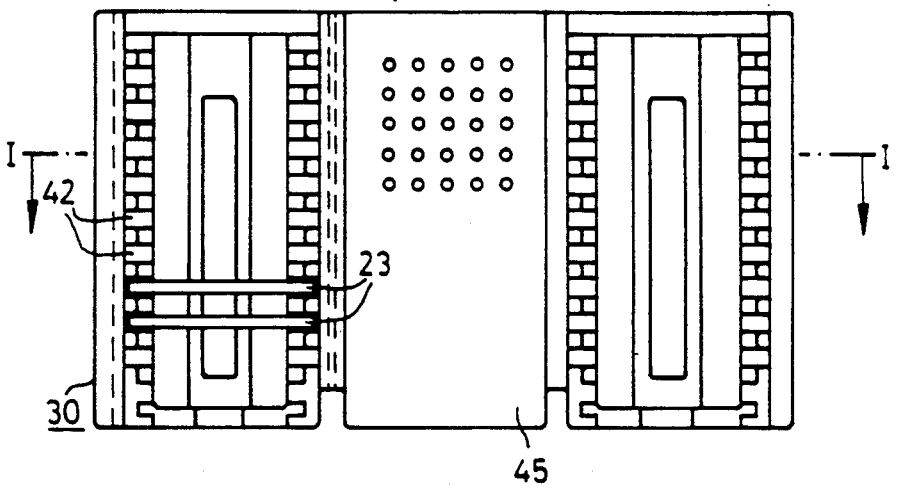
FIG. 2 shows the quenching chamber housing according to FIG. 1 in a front view. The line I—I designates the section plane of the quenching chamber housing in FIG. 1.

According to FIG. 2, the quenching baffles 23 are inserted into slots 42 of the outside walls 43 and the partitions 36 of the quenching chamber housing. The quenching baffles 23 are fixed in their longitudinal direction by the provision that the ends of the legs 25 of the quenching baffles abut against a stop surface 44 of the quenching chamber housing 30, which is formed between the inclined wall surfaces 41 and the outside walls 43 and the partitions 36, respectively. Furthermore, the quenching baffles 23 are fixed on their opposite sides by a perforated blowout shield 45 which is provided in slots 46 of the outside walls 43 and the partitions 36 of the quenching chamber housing 30. A blowout shield 45 is shown in FIG. 2 in the vicinity of the middle quenching chamber 3.

Before the quenching chamber housing 30 is installed in a circuit breaker, the former is provided with the quenching baffles and the blowout shields 45. This unit is then inserted into the lower housing part 1 so that the quenching chambers for all poles of the switchgear are installed by a single operation. The procedure can be the same if the switchgear has a smaller or larger number of poles by designing the quenching chamber housing accordingly for two or four quenching chambers. By putting on a corresponding upper housing part, the quenching chamber housing is then enclosed on all sides and is thereby fastened at or in the insulating material housing.

Figure 3:
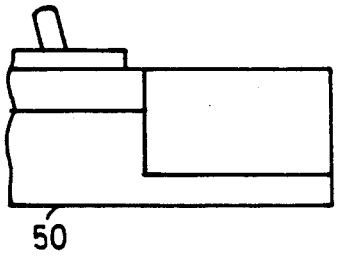
FIGS. 3 and 4 show schematically in a side view and a top view a further embodiment with a quenching chamber housing which also contains connecting spaces.
Figure 4:
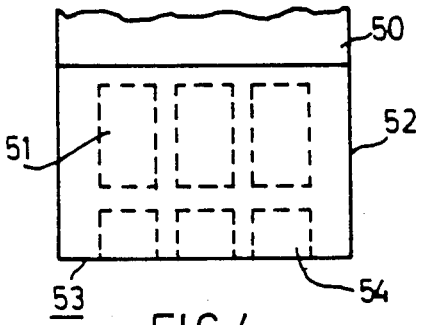

Deviating from the embodiment described above, the outside wall of a lower housing part 50 can be formed in the region of quenching chambers 51 directly by the outside walls 52 of a quenching chamber housing 53, as is schematically shown in FIGS. 3 and 4. In this case it is advisable to select the wall thickness of a quenching chamber housing 53 on the outside so that it corresponds, in the example according to FIGS. 1 and 2, to the joint thickness of the outside walls 43 of the quenching chamber housing 30 and the outside walls of the lower housing part 1. As FIGS. 3 and 4 further show, the connecting spaces 54 are likewise contained in the quenching chamber housing 53.

In the foregoing specification, the invention has been described with reference to a specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A multipole low-voltage circuit breaker having an insulating material housing and an arc quenching chamber for each pole, each chamber comprising a quenching baffle and all the chambers being arranged in a single quenching chamber housing, the quenching chamber housing having walls and being subdivided by partitions and being connected to the insulating material housing of the circuit breaker, the quenching baffles being fastened to the partitions and walls of the quenching chambers.

2. The circuit breaker recited in claim 1, wherein the partitions and walls of the quenching chambers of the quenching chamber housing have recesses for receiving the quenching baffles.

3. The circuit breaker recited in claim 1, wherein the quenching chambers have openings for receiving movable contact levers and wherein the partition and walls of the quenching chambers, starting from the openings, are arranged in an approximately wedge-shaped, diverging manner, the partitions and walls comprising a material which emits gas under the influence of the temperature of the arc.

4. The circuit breaker recited in claim 1, wherein the insulating material housing has a recess receiving the quenching chamber housing.

5. The circuit breaker recited in claim 1, wherein the quenching chamber housing corresponds to the width of the insulating material housing and forms locally the outside walls thereof.

6. The circuit breaker recited in claim 5, wherein the quenching chamber housing contains connecting spaces associated with each quenching chamber.

* * * * *